US011590765B2

(12) United States Patent
Someno

(10) Patent No.: US 11,590,765 B2
(45) Date of Patent: Feb. 28, 2023

(54) IMAGE FORMING DEVICE AND IMAGE FORMATION METHOD

(71) Applicant: SEIKO EPSON CORPORATION, Tokyo (JP)

(72) Inventor: Masahiro Someno, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 25 days.

(21) Appl. No.: 17/201,694

(22) Filed: Mar. 15, 2021

(65) Prior Publication Data

US 2021/0291552 A1 Sep. 23, 2021

(30) Foreign Application Priority Data

Mar. 18, 2020 (JP) ..... JP2020-047316

(51) Int. Cl.

| | |
|---|---|
| ***B41J 2/165*** | (2006.01) |
| ***B41J 29/393*** | (2006.01) |
| ***B41J 2/21*** | (2006.01) |
| ***B41J 11/70*** | (2006.01) |

(52) U.S. Cl.

CPC ..... *B41J 2/2132* (2013.01); *B41J 2/16579* (2013.01); *B41J 11/70* (2013.01)

(58) Field of Classification Search

CPC .... B41J 29/393; B41J 2/0451; B41J 2/16579; B41J 2/2132; G06K 15/027

See application file for complete search history.

(56) References Cited

FOREIGN PATENT DOCUMENTS

| | | | | |
|---|---|---|---|---|
| JP | 2001-347488 A | 12/2001 | | |
| JP | 2003-211755 A | 7/2003 | | |
| JP | 4493233 B2 * | 6/2010 | ..... | B41J 2/16585 |

* cited by examiner

*Primary Examiner* — Julian D Huffman

(74) *Attorney, Agent, or Firm* — Workman Nydegger

(57) ABSTRACT

An ink jet printer includes a transporting section configured to transport continuous paper in a transport direction, an ink jet head forming a nozzle array having a plurality of nozzles aligned in the transport direction, a cutting section configured to cut the continuous paper in an intersecting direction, and a controller configured to control the transporting section, the ink jet head, and the cutting section. The controller causes the ink jet head to form, on the continuous paper, a first image and a second image that are adjacent to one another in the transport direction, causes a nozzle among the nozzles aligned in the nozzle array to form a test pattern in a region between the first image and the second image, and causes the cutting section to cut the continuous paper to separate, from the continuous paper, the inter-image region in which the test pattern was formed.

10 Claims, 6 Drawing Sheets

IMAGE FORMING DEVICE AND IMAGE FORMATION METHOD

The present application is based on, and claims priority from JP Application Serial Number 2020-047316, filed Mar. 18, 2020, the disclosure of which is hereby incorporated by reference herein in its entirety.

BACKGROUND

1. Technical Field

The present disclosure relates to an image forming device and an image formation method.

2. Related Art

A device that forms a test pattern on continuous paper is known. For example, JP-A-2001-347488 discloses a technique for forming, on continuous paper, a test pattern to be used to monitor a printing state once per 100 pages or 1000 pages in a device that cuts continuous paper to generate paper sheets.

The device described in JP-A-2001-347488 may form a plurality of images on continuous paper such that a gap is present between the images. In this case, in a method of forming the test pattern after the formation of the plurality of images as described in JP-A-2001-347488, a region that is not used to form an image other than the test pattern increases on the continuous paper.

SUMMARY

To solve the foregoing problem, according to an aspect, an image forming device includes a transporting section configured to transport continuous paper in a first direction, an ink jet head including a nozzle array having a plurality of nozzles aligned in the first direction, a cutting section configured to cut the continuous paper in a second direction intersecting the first direction, and a controller configured to control the transporting section, the ink jet head, and the cutting section. The controller causes the ink jet head to form, on the continuous paper, a first image and a second image that are adjacent to one another in the first direction, causes a nozzle among the nozzles included in the nozzle array to form a test pattern in a region between the first image and the second image, and causes the cutting section to cut the continuous paper to separate, from the continuous paper, the region in which the test pattern was formed and that is between the first image and the second image.

To solve the foregoing problem, according to another aspect, an image formation method includes transporting continuous paper in a first direction, forming a first image on the continuous paper by an ink jet head including a nozzle array having a plurality of nozzles aligned in the first direction, forming a test pattern by a nozzle among the nozzles included in the nozzle array, the test pattern being upstream with respect to the first image in the first direction, forming a second image by the ink jet head, the second image being upstream with respect to the test pattern in the first direction, and separating a region in which the test pattern was formed and that is between the first image and the second image from a first printed matter with the first image printed thereon and a second printed matter with the second image printed thereon by cutting the continuous paper in a second direction intersecting the first direction.

DESCRIPTION OF EXEMPLARY EMBODIMENTS

First Embodiment

Figure 1:
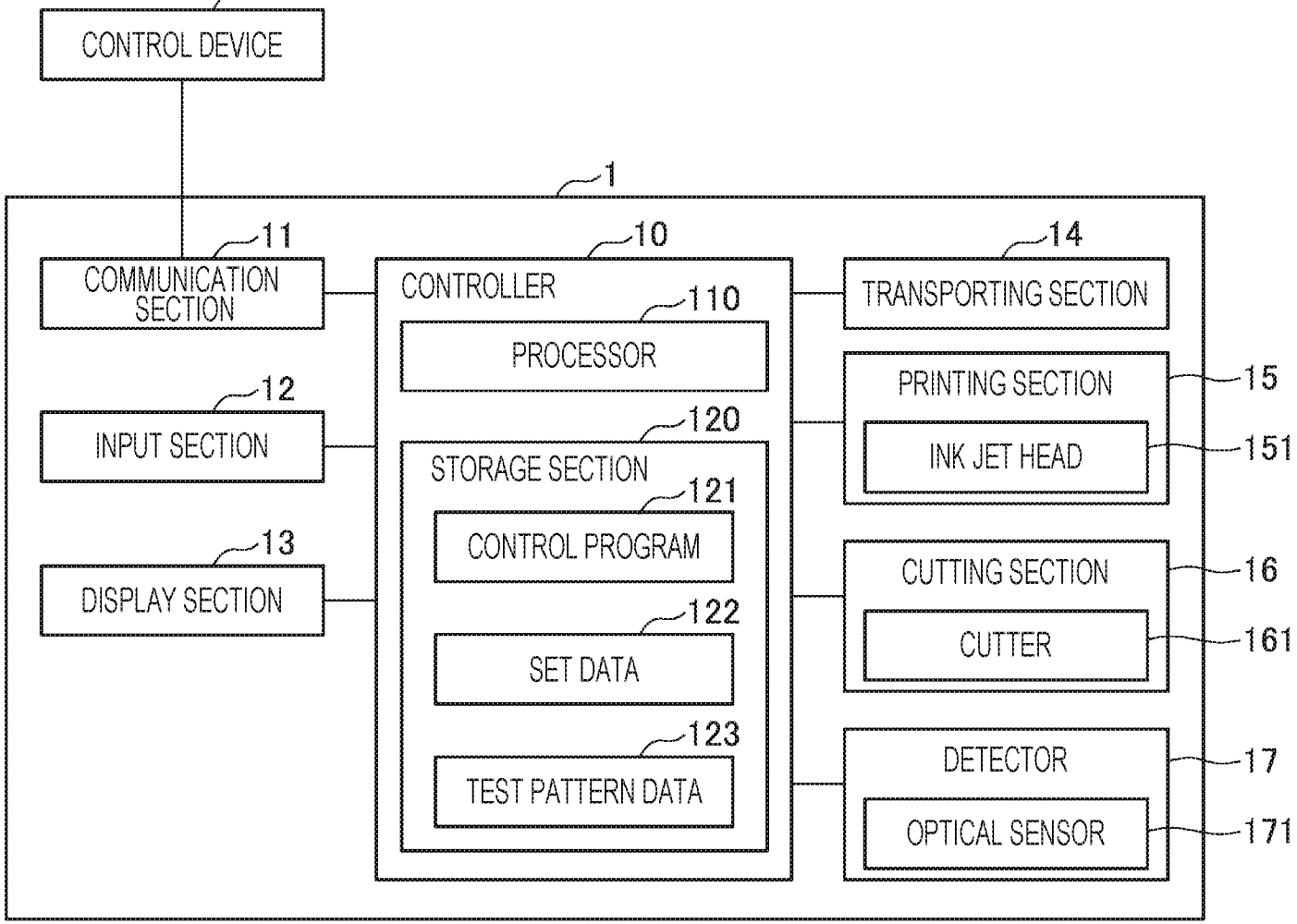
FIG. 1 is a diagram illustrating a configuration of an ink jet printer.

FIG. 1 is a diagram illustrating a configuration of an ink jet printer 1. The ink jet printer 1 corresponds to an example of an image forming device.

The ink jet printer 1 includes a controller 10, a communication section 11, an input section 12, a display section 13, a transporting section 14, a printing section 15, a cutting section 16, and a detector 17.

The controller 10 includes a processor 110 and a storage section 120 and controls the sections of the ink jet printer 1. The processor 110 is a CPU, an MPU, or the like and executes a program. The controller 10 causes the processor 110 to read a control program 121 stored in the storage section 120 and execute a process and controls the execution of various processes by causing the hardware and the software to collaborate with one another.

The storage section 120 has a storage region storing the program to be executed by the processor 110 and data to be processed by the processor 110. The storage section 120 stores the control program 121 to be executed by the processor 110, set data 122, and test pattern data 123. The set data 122 includes a set value relating to an operation of the ink jet printer 1. The test pattern data 123 indicates a test pattern TP to be used to detect whether each of nozzles Nz included in an ink jet head 151 is in a defective state and whether each of the nozzles Nz causes flight deviation. The defective state indicates a state in which the nozzle Nz does not appropriately eject ink due to clogging of the nozzle Nz with ink, drying of ink remaining in the nozzle Nz, dirt of the nozzle Nz, or another cause. The flight deviation indicates that ink ejected from the nozzle Nz lands at a position different from a desired landing position. The storage section 120 may store another program and other data, as well as the control program 121, the set data 122, and the test pattern data 123. The storage section 120 has a nonvolatile storage region for storing the program and the data in a nonvolatile manner. The storage section 120 may have a volatile storage region and may have a work area for temporarily storing the program to be executed by the processor 110 and the data to be processed by the processor 110.

The communication section 11 includes hardware, such as a connector, an interface circuit, and the like and communicates with an external device in accordance with a predetermined communication standard under control by the controller 10. The communication standard to be used by the communication section 11 to communicate with the external device may be a communication standard for wireless communication or may be a communication standard for wired communication.

A control device 2 is the external device that communicates with the ink jet printer 1. The control device 2 is a computer to be operated by a user. The control device 2 communicates with the ink jet printer 1 and transmits, to the ink jet printer 1, job data that causes the ink jet printer 1 to execute printing and form an image on continuous paper R. The job data transmitted by the control device 2 includes a control command corresponding to a command system of the ink jet printer 1 and image data of the image to be formed on the continuous paper R.

The input section 12 includes an operation switch installed in a housing of the ink jet printer 1. The input section 12 detects an operation executed on the operation switch and outputs a signal indicating the detected operation to the controller 10. The controller 10 controls a process corresponding to the operation based on the signal input from the input section 12.

The display section 13 is a plurality of LEDs, a display panel, or the like. The LEDs are turned on and off in a predetermined manner under control by the controller 10. The display panel displays information or the like under control by the controller 10.

The transporting section 14 has configurations relating to transport of the continuous paper R. That is, the transporting section 14 includes a transport motor that transports the continuous paper R in a transport direction HY, a transport roller that rotates by driving of the transport motor, and a power transmission mechanism that transmits power of the transport motor to the transport roller. The transporting section 14 transports the continuous paper R in the transport direction HY in accordance with control by the controller 10.

The printing section 15 includes mechanisms relating to printing. That is, the printing section 15 includes the ink jet head 151, a carriage, a carriage driving motor, and a driving circuit. The ink jet head 151 is mounted on the carriage. The carriage driving motor moves the carriage in a direction KY intersecting the transport direction HY of the continuous paper R. The driving circuit drives the ink jet head 151. The transport direction HY corresponds to a first direction, while the intersecting direction KY corresponds to a second direction. The printing section 15 forms an image on the continuous paper R in accordance with control by the controller 10. The present embodiment exemplifies, as the intersecting section KY, a direction perpendicular to the transport direction HY.

Figure 2:
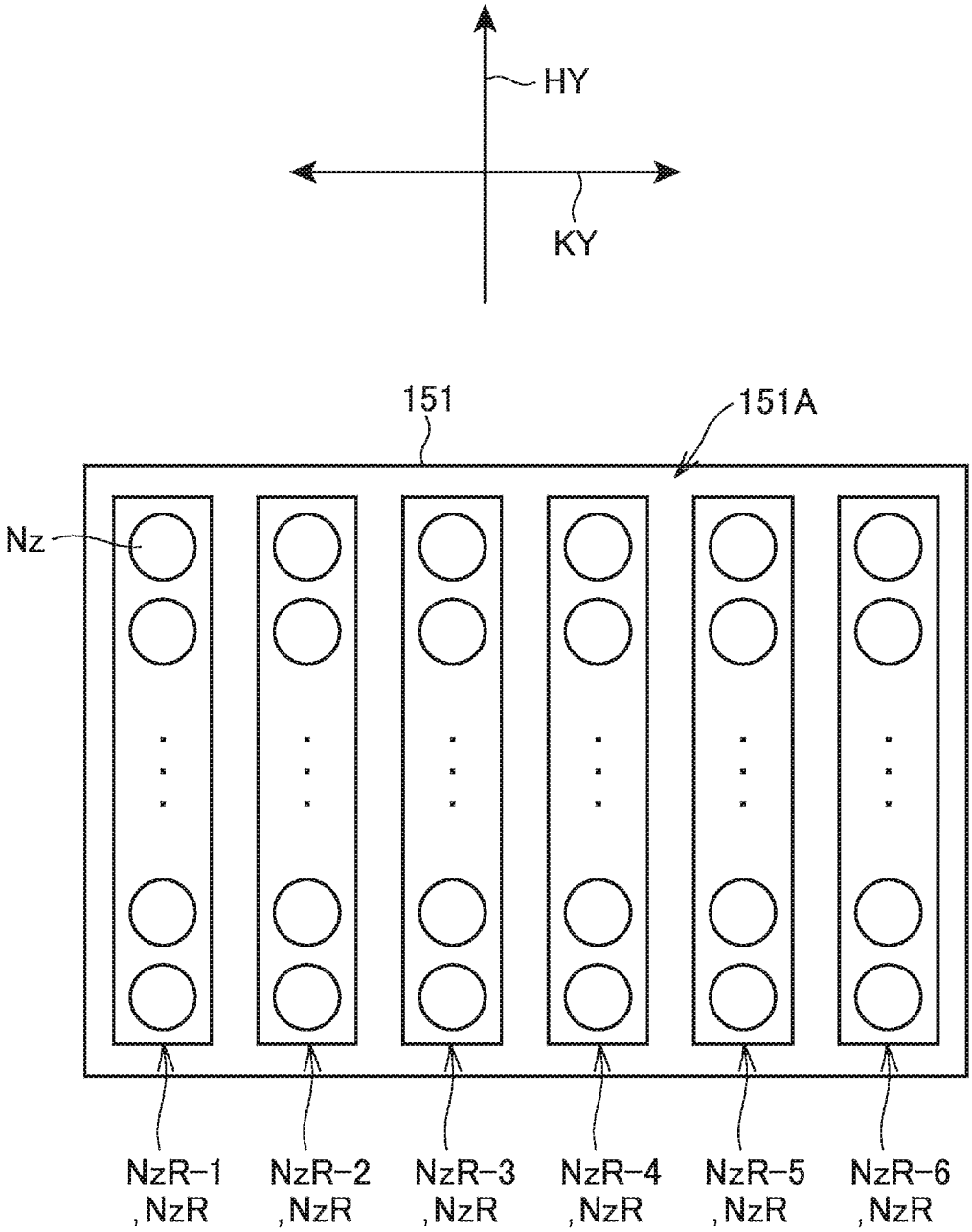
FIG. 2 is a diagram for explaining an ink jet head.

FIG. 2 is a diagram for explaining the ink jet head 151.

The ink jet head 151 has an ink ejection surface 151A that may be located opposite to an image formable region RA of the continuous paper R. The ink jet head 151 includes a plurality of nozzle arrays NzR arranged side by side in the intersecting direction KY on the ink ejection surface 151A. Each of the nozzle arrays NzR includes a plurality of nozzles Nz aligned in the transport direction HY. Each of the nozzles Nz ejects ink. The image formable region RA is a region in which images including the test pattern TP can be formed. The present embodiment exemplifies a case in which the ink jet head 151 has 6 nozzle arrays NzR1, NzR2, NzR3, NzR4, NzR5, and NzR6. The number of nozzle arrays NzR included in the ink jet head 151 is not limited to 6 and may be larger than 6 or smaller than 6. The nozzle arrays NzR included in the ink jet head 151 eject ink of different colors. The exemplified 6 nozzle arrays NzR included in the ink jet head 151 eject cyan ink, magenta ink, yellow ink, black ink, light cyan ink, and light magenta ink.

Returning to FIG. 1, the cutting section 16 includes mechanisms relating to cutting of the continuous paper R. That is, the cutting section 16 includes a cutter 161 and a driving circuit that drives the cutter 161. The cutter 161 has a fixed blade and a movable blade that moves to cross the fixed blade. The cutting section 16 cuts the continuous paper R in the intersecting direction KY in accordance with control by the controller 10.

The detector 17 includes an optical sensor 171 and other various sensors. The optical sensor 171 detects the test pattern TP formed on the continuous paper R by the printing section 15. The detector 17 outputs a result of the detection to the controller 10. The optical sensor 171 is installed downstream with respect to the ink jet head 151 in the transport direction HY and upstream with respect to the cutter 161 in the transport direction HY. The controller 10 detects, based on the result of the detection by the optical sensor 171, whether each of the nozzles Nz included in the ink jet head 151 is in the defective state and whether each of the nozzles Nz causes the flight deviation.

Next, an operation of the ink jet printer 1 to generate a plurality of printed matters not having a white space in the transport direction HY is described.

Figure 3:
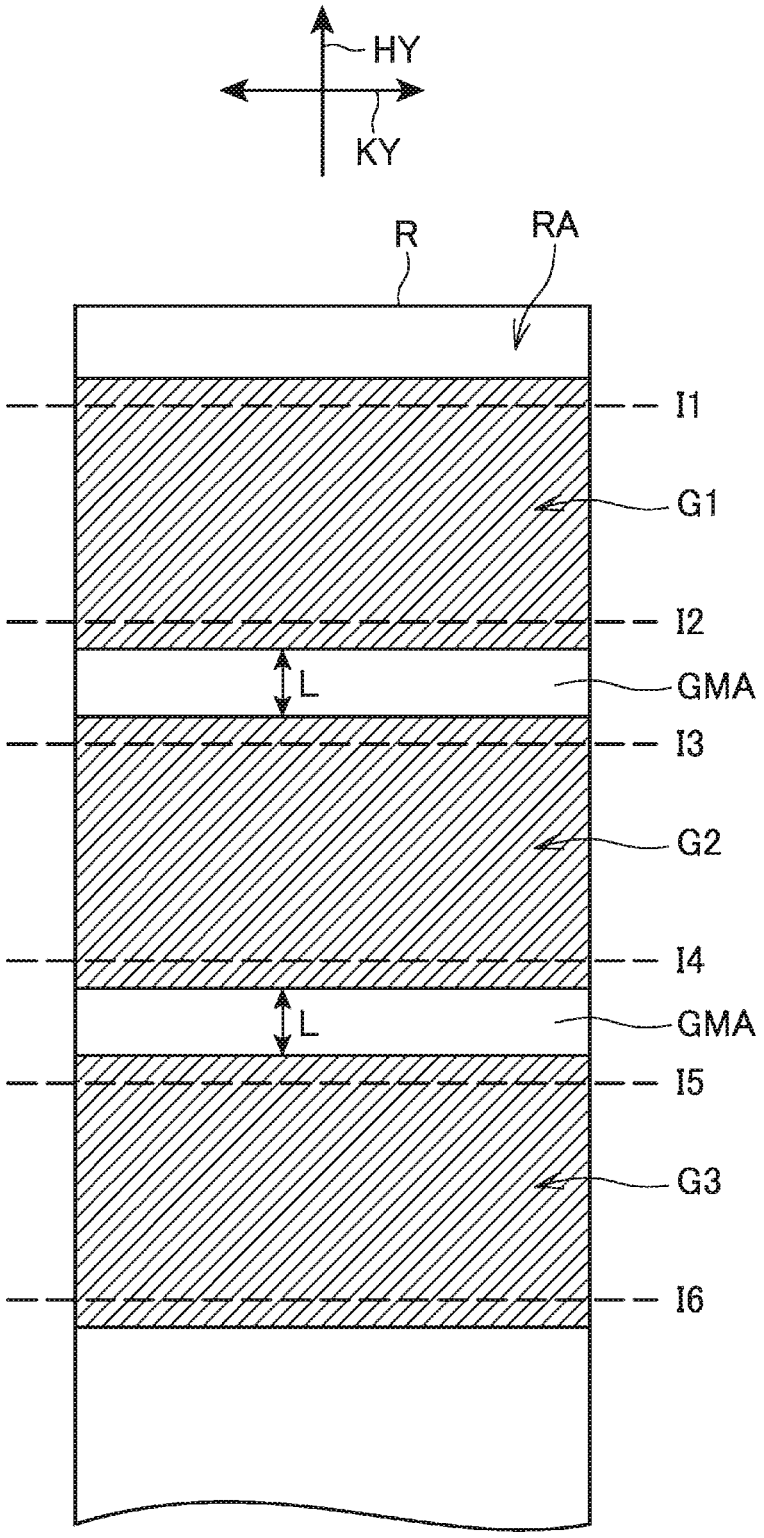
FIG. 3 is a diagram for explaining an operation of the ink jet printer.

FIG. 3 is a diagram for explaining the operation of the ink jet printer 1. Each of images G1, G2, G3, and G4 illustrated in FIG. 3 is not the test pattern TP and is printed based on job data transmitted by the control device 2.

The ink jet printer 1 causes the printing section 15 to form the image G1 on the continuous paper R. After forming the image G1, the ink jet printer 1 transports the continuous paper R and causes the cutting section 16 to cut the continuous paper R at a position I1. The position I1 indicates a position on the continuous paper R in the transport direction HY of the continuous paper R. The position I1 is at a downstream end of a generated printed matter in the transport direction HY. The position I1 is upstream with respect to a downstream end of the formed image G1 in the transport direction HY. After causing the cutting section 16 to cut the continuous paper R at the position I1, the ink jet printer 1 transports the continuous paper R and causes the cutting section 16 to cut the continuous paper R at a position I2. The position I2 indicates a position on the continuous paper R in the transport direction HY. The position I2 is at an upstream end of the generated printed matter in the transport direction HY. The position I2 is downstream with respect to an upstream end of the formed image G1 in the transport direction HY. By cutting the continuous paper R at the positions I1 and I2, the ink jet printer 1 generates the printed matter that has the image G1 formed thereon and does not have a white space in the transport direction HY.

The ink jet printer 1 causes the printing section 15 to form the image G2 such that the image G2 is upstream with respect to the image G1 in the transport direction HY and that a gap of a length L is present between the image G1 and the image G2. After forming the image G2, the ink jet printer 1 transports the continuous paper R and causes the cutting section 16 to cut the continuous paper R at a position I3. The position I3 indicates a position on the continuous paper R in the transport direction HY. The position I3 is at a downstream end of a generated printed matter with the image G2 printed thereon in the transport direction HY. The position I3 is upstream with respect to a downstream end of the printed image G2 in the transport direction HY. After causing the cutting section 16 to cut the continuous paper R at the position I3, the ink jet printer 1 transports the continuous paper R and causes the cutting section 16 to cut the continuous paper R at a position I4. The position I4 indicates a position on the continuous paper R in the transport direction HY. The position I4 is at an upstream end of the printed matter with the image G2 printed thereon in the transport direction HY. The position I4 is downstream with respect to an upstream end of the printed image G2 in the transport direction HY. By cutting the continuous paper R at the positions I3 and I4, the ink jet printer 1 generates the printed matter that has the image G2 formed thereon and does not have a white space in the transport direction HY.

The ink jet printer 1 causes the printing section 15 to form the image G3 such that the image G3 is upstream with respect to the image G2 in the transport direction HY and that a gap of the length L is present between the image G2 and the image G3. After forming the image G3, the ink jet printer 1 transports the continuous paper R and causes the cutting section 16 to cut the continuous paper R at a position I5. The position I5 indicates a position on the continuous paper R in the transport direction HY. The position I5 is at a downstream end of a printed matter with the image G3 printed thereon in the transport direction HY. The position I5 is upstream with respect to a downstream end of the printed image G3 in the transport direction HY. After causing the cutting section 16 to cut the continuous paper R at the position I5, the ink jet printer 1 transports the continuous paper R and causes the cutting section 16 to cut the continuous paper R at a position I6. The position I6 indicates a position on the continuous paper R in the transport direction HY. The position I6 is at an upstream end of the printed matter with the image G3 printed thereon in the transport direction HY. The position I6 is downstream with respect to an upstream end of the printed image G3 in the transport direction HY. By cutting the continuous paper R at the positions I5 and I6, the ink jet printer 1 generates the printed matter that has the image G3 formed thereon and does not have a white space in the transport direction HY.

When an image is to be formed after the formation of the image G3, the ink jet printer 1 repeatedly forms an image such that a gap of the length L is present between the formed image and another image, and causes the cutting section 16 to cut both ends in the transport direction HY of the formed image to generate a printed matter not having a white space in the transport direction HY.

In the following description, a region that is within an image formable region RA of the continuous paper R and is present between adjacent images other than the test pattern TP is referred to as an "inter-image region" and is indicated by a sign "GMA". A length of the inter-image region GMA in the transport direction HY is determined based on a time period for a single cutting operation and a time period for the cutter 161 to wait for an operation between two continuous cutting operations. The length of the inter-image region GMA in the transport direction HY is recorded as the set value in the set data 122.

Next, an operation of the ink jet printer 1 to form the test pattern TP on the continuous paper R is described.

Figure 4:
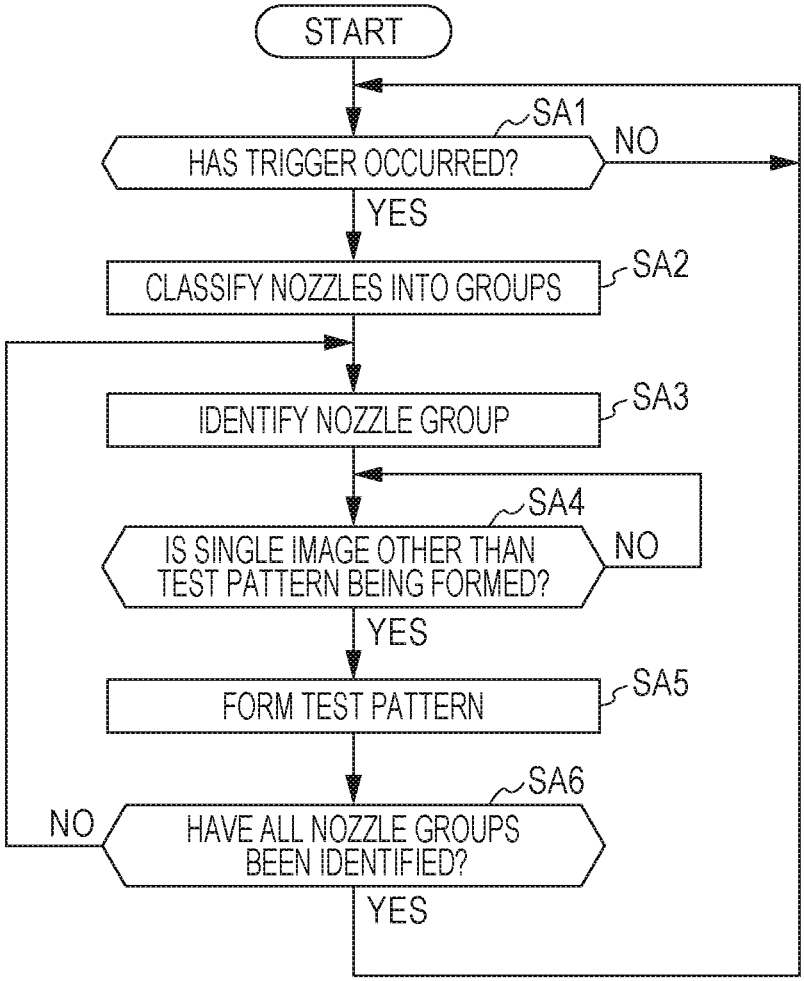
FIG. 4 is a flowchart illustrating an operation of the ink jet printer.

FIG. 4 is a flowchart illustrating the operation of the ink jet printer 1 to form the test pattern TP on the continuous paper R.

In the operation illustrated in FIG. 4, the ink jet printer 1 executes the image formation operation described with reference to FIG. 3. In the operation illustrated in FIG. 4, the number of images that are not the test pattern TP and are to be formed on the continuous paper R is larger than the number of test patterns TP to be formed on the continuous paper R.

The controller 10 of the ink jet printer 1 determines whether a trigger for forming the test pattern TP on the continuous paper R has occurred (step SA1).

In step SA1, the controller 10 determines whether a predetermined number of images other than the test pattern TP have been formed on the continuous paper R by the printing section 15. In step SA1, when the controller 10 determines that the predetermined number of images other than the test pattern TP have been formed on the continuous paper R, the controller 10 determines that the trigger for forming the test pattern TP on the continuous paper R has occurred. Alternatively, in step SA1, when the printing section 15 continuously forms images other than the test pattern TP for a predetermined time period or longer, the controller 10 determines that the trigger for forming the test pattern TP on the continuous paper R has occurred.

The controller 10 classifies, into groups, the nozzles Nz that form the test pattern TP (step SA2).

Figure 5:
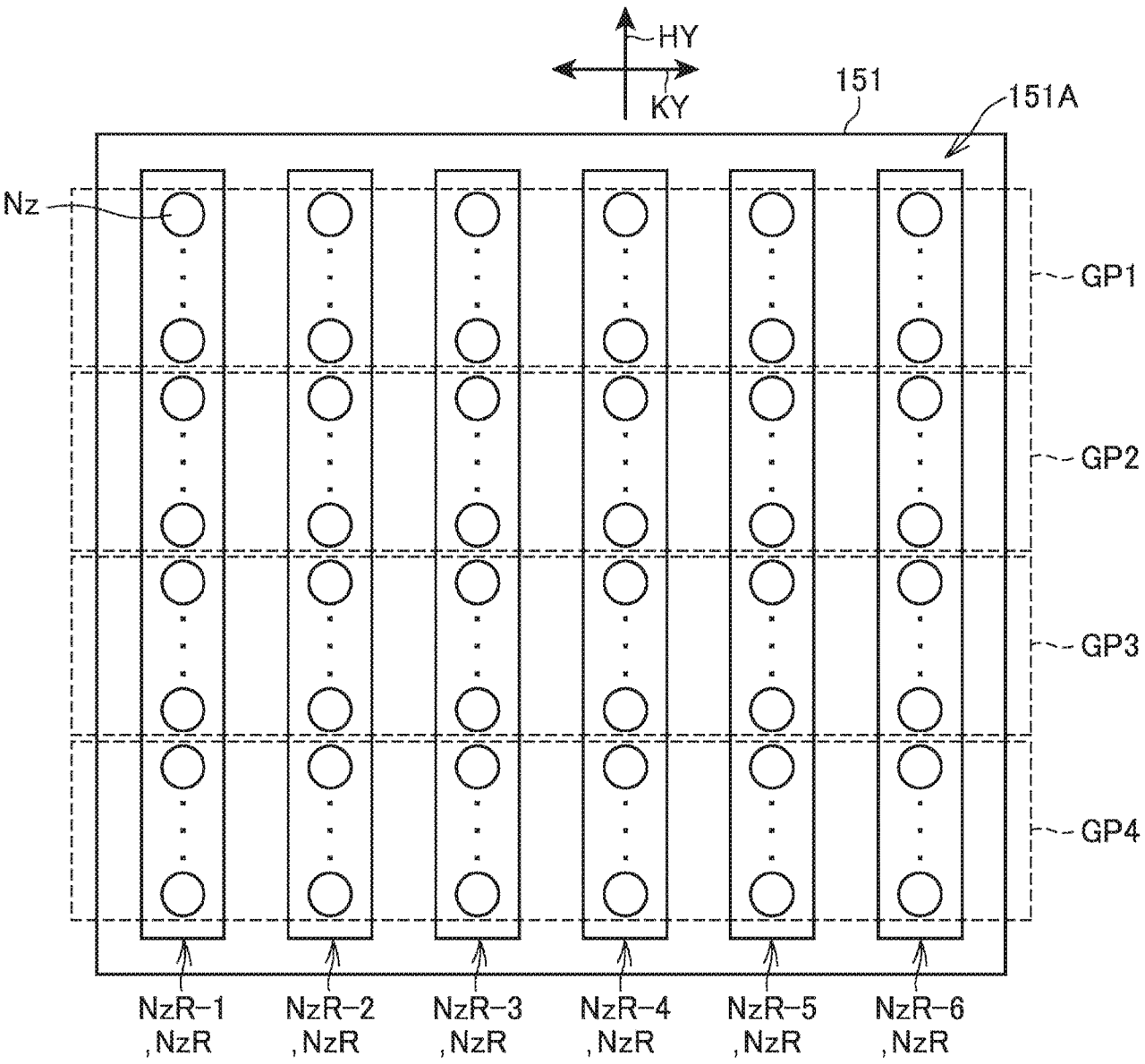
FIG. 5 is a diagram for explaining classification of nozzles in groups.

FIG. 5 is a diagram for explaining the classification of the nozzles Nz in the groups.

It is assumed that the number of nozzles Nz included in each of the nozzle arrays NzR is 180. The case where the number of nozzles Nz is 180 is an example. The number of nozzles Nz included in each of the nozzle arrays NzR may be larger than 180 or may be smaller than 180.

The controller 10 acquires, from the set data 122, the length of the inter-image region GMA in the transport direction HY. In the case illustrated in FIG. 3, the length of the inter-image region GMA in the transport direction HY is L. Next, the controller 10 calculates the maximum number of nozzles Nz aligned in the transport direction HY and able to form the test pattern TP in the inter-image region GMA. The controller 10 calculates the maximum number of nozzles Nz aligned in the transport direction HY and able to form the test pattern TP in the inter-image region GMA, based on a length of the test pattern TP formed by a single nozzle Nz in the transport direction HY and the acquired length of the inter-image region GMA in the transport direction HY. Then, the controller 10 classifies the nozzles Nz included in the ink jet head 151 into groups such that the number of nozzles N classified in each of the groups and aligned in the transport direction HY is equal to or smaller than the calculated maximum number.

FIG. 5 exemplifies the case where the maximum number of nozzles Nz aligned in the transport direction HY and able to form the test pattern TP in the inter-image region GMA is 45. In FIG. 5, the controller 10 classifies the nozzles Nz into 4 groups such that the number of nozzles Nz included in each of the groups and aligned in the transport direction HY is 45. In the following description, each of the groups is referred to as a "nozzle group" in some cases. The controller 10 may classify the nozzles Nz into 5 or more groups. The controller 10 may classify the nozzles Nz into groups such that the numbers of nozzles Nz included in the groups and aligned in the transport direction HY are not the same.

Return to the description of the flowchart of FIG. 4. After classifying the nozzles Nz that form the test pattern TP into the groups, the controller 10 identifies a single nozzle group among the groups (step SA3). The identification of step SA3 is executed in the order from the most upstream nozzle group in the transport direction HY to the most downstream nozzle group in the transport direction HY. In this case, the controller 10 stores the identified nozzle group. In FIG. 4, the identification of step SA3 is executed after the occurrence of the trigger. However, before the occurrence of the trigger, the identification of step SA3 may be executed based on a history of the formation of the test pattern TP.

The controller 10 determines whether a single image other than the test pattern TP is being formed by the printing section 15 (step SA4).

When the controller 10 determines that the single image other than the test pattern TP is being formed (YES in step SA4), the controller 10 makes the determination of step SA4 again.

When the controller 10 determines that the image other than the test pattern TP is not being imaged (NO in step SA4), the controller 10 uses the nozzle group Nz identified in step SA3 to control the formation of the test pattern TP in the inter-image region GMA after the formation of the image other than the test pattern TP (step SA5).

The controller 10 determines whether the controller 10 has identified all the nozzle groups in step SA3 (step SA6).

When the controller 10 determines that the controller 10 has not identified one or more of all the nozzle groups (NO in step SA6), the controller 10 causes the process to return to step SA3, identifies a single unidentified nozzle group, and controls the processes of step SA4 and later.

When the controller 10 determines that the controller 10 has identified all the nozzle groups (YES in step SA6), the controller 10 causes the process to return to step SA1.

The operation of the flowchart illustrated in FIG. 4 is described in detail with reference to FIG. 6.

Figure 6:
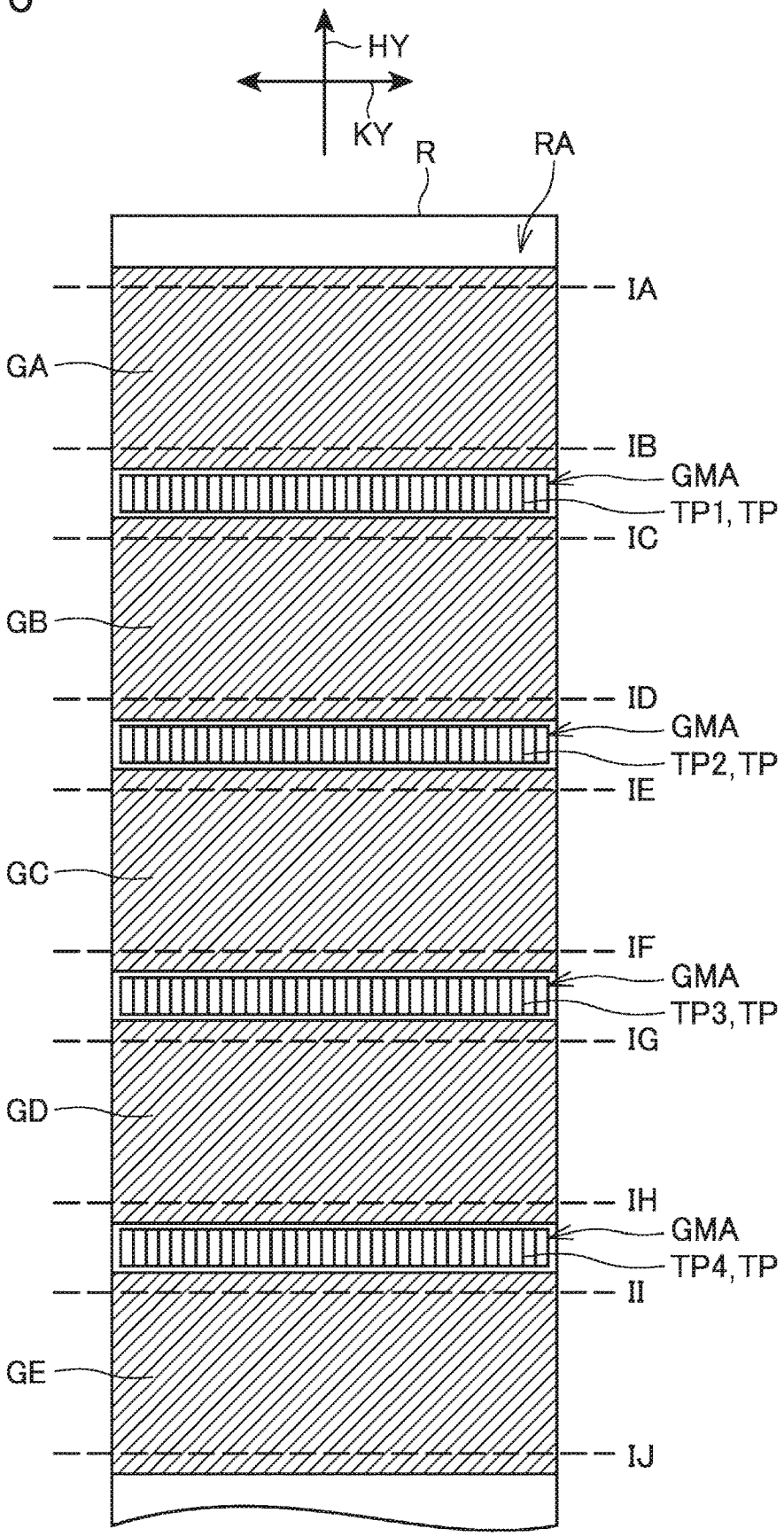
FIG. 6 is a diagram for explaining an operation of the ink jet printer.

FIG. 6 is a diagram for explaining the operation of the ink jet printer 1 to form test patterns TP. Images GA, GB, GC, GD, and GE illustrated in FIG. 6 are not the test patterns TP.

In the description with reference to FIG. 6, the nozzles Nz of the ink jet head 151 are classified into 4 nozzle groups GP1, GP2, GP3, and GP4, as described with referenced to FIG. 5.

The ink jet printer 1 causes the printing section 15 to form the image GA on the continuous paper R. After forming the image GA, the ink jet printer 1 causes the nozzle group GP1 to form the test pattern TP in an inter-image region GMA that is upstream with respect to and adjacent to the image GA in the transport direction HY. The test pattern TP formed by the nozzle group GP1 is hereinafter referred to as "test pattern TP1".

After forming the test pattern TP1 on the continuous paper R in accordance with control by the controller 10, the printing section 15 forms the image GB in an image formable region RA that is upstream with respect to and adjacent to the inter-image region GMA with the test pattern TP1 formed therein in the transport direction HY. After forming the image GB on the continuous paper R in accordance with control by the controller 10, the printing section 15 causes the nozzle group GP2 to form the test pattern TP in an inter-image region GMA that is upstream with respect to and adjacent to the image GB in the transport direction HY. The test pattern TP formed by the nozzle group GP2 is hereinafter referred to as "test pattern TP2".

After forming the test pattern TP2 on the continuous paper R in accordance with control by the controller 10, the printing section 15 forms the image GC in an image formable region RA that is upstream with respect to and adjacent to the inter-image region GMA with the test pattern TP2 formed therein in the transport direction HY. After forming the image GC on the continuous paper R in accordance with control by the controller 10, the printing section 15 causes the nozzle group GP3 to form the test pattern TP in an inter-image region GMA that is upstream with respect to and adjacent to the image GC in the transport direction HY. The test pattern formed by the nozzle group GP3 is hereinafter referred to as "test pattern TP3".

After forming the test pattern TP3 on the continuous pattern R in accordance with control by the controller 10, the printing section 15 forms the image GD in an image formable region RA that is upstream with respect to and adjacent to the inter-image region GMA with the test pattern TP3 formed therein in the transport direction HY. After forming the image GD on the continuous paper R in accordance with control by the controller 10, the printing section 15 causes the nozzle group GP4 to form the test pattern TP in an inter-image region GMA that is upstream with respect to and adjacent to the image GD in the transport direction HY. The test pattern formed by the nozzle group GP4 is hereinafter referred to as "test pattern TP4".

In the foregoing manner, the test patterns TP are formed on the continuous pattern R by all the nozzles Nz included in the ink jet head 151.

After forming the test patterns TP on the continuous paper R using all the nozzles Nz included in the ink jet head 151, the ink jet printer 1 forms, on the continuous paper R, one or multiple images including an image GE in an image formable region RA that is upstream with respect to the test pattern TP4 in the transport direction HY. The one or multiple images including the image GE are not the test pattern TP.

The cutting section 16 cuts the continuous paper R at positions IA, IB, IC, ID, IE, IF, IG, IH, II, and IJ illustrated in FIG. 6 in accordance with control by the controller 10.

The position IA indicates a position on the continuous paper R in the transport direction HY. The position IA is at a downstream end of a printed matter with the image GA printed thereon in the transport direction HY. The position IA is upstream with respect to a downstream end of the printed image GA in the transport direction HY.

The position IB indicates a position on the continuous paper R in the transport direction HY. The position IB is at an upstream end of the printed matter with the image GA printed thereon in the transport direction HY. The position IB is downstream with respect to an upstream end of the printed image GA in the transport direction HY.

The position IC indicates a position on the continuous paper R in the transport direction HY. The position IC is at a downstream end of a printed matter with the image GB printed thereon in the transport direction HY. The position IC is upstream with respect to a downstream end of the printed image GB in the transport direction HY.

The position ID indicates a position on the continuous paper R in the transport direction HY. The position ID is at an upstream end of the printed matter with the image GB printed thereon in the transport direction HY. The position ID is downstream with respect to an upstream end of the printed image GB in the transport direction HY.

The position IE indicates a position on the continuous paper R in the transport direction HY. The position IE is at a downstream end of a printed matter with the image GC printed thereon in the transport direction HY. The position IE is upstream with respect to a downstream end of the printed image GC in the transport direction HY.

The position IF indicates a position on the continuous paper R in the transport direction HY. The position IF is at an upstream end of the printed matter with the image GC printed thereon in the transport direction HY. The position IF is downstream with respect to an upstream end of the printed image GC in the transport direction HY.

The position IG indicates a position on the continuous paper R in the transport direction HY. The position IG is at a downstream end of a printed matter with the image GD printed thereon in the transport direction HY. The position IG is upstream with respect to a downstream end of the printed image GD in the transport direction HY.

The position IH indicates a position on the continuous paper R in the transport direction HY. The position IH is at an upstream end of the printed matter with the image GD printed thereon in the transport direction HY. The position IH is downstream with respect to an upstream end of the printed image GD in the transport direction HY.

The position II indicates a position on the continuous paper R in the transport direction HY. The position II is at a downstream end of a printed matter with the image GE printed thereon in the transport direction HY. The position II is upstream with respect to a downstream end of the printed image GE in the transport direction HY.

The position IJ indicates a position on the continuous paper R in the transport direction HY. The position IJ is at an upstream end of the printed matter with the image GE printed thereon in the transport direction HY. The position IJ is downstream with respect to an upstream end of the printed image GE in the transport direction HY.

By causing the cutting section 16 to cut the continuous paper R at the positions IA to IJ, the ink jet printer 1 generates the printed matter with the image GA formed thereon, the printed matter with the image GB formed thereon, the printed matter with the image GC formed thereon, the printed matter with the image GD formed thereon, and the printed matter with the image GE formed thereon. Each of the printed matters does not have a white space in the transport direction HY.

Next, a plurality of other embodiments are described.

Second Embodiment

The nozzles Nz included in the ink jet head 151 are classified into groups in advance, and information of the classification of the nozzles Nz in the groups is stored in the storage section 120 or the like.

The nozzles Nz included in the ink jet head 151 are classified into the groups before the trigger occurs in step SA1.

Third Embodiment

The ink jet printer 1 includes a cutting section 16 with two cutters 161, instead of the cutting section 16 described in the first embodiment. The two cutters 161 are downstream with respect to the ink jet head 151 in the transport direction HY and arranged side by side in the transport direction HY. The controller 10 controls the cutting section 16 to cause the two cutters 161 to operate simultaneously and cut the continuous paper R at two positions on the continuous paper R in a single cutting operation.

In the case described with reference to FIG. 6, the two cutters 161 cut the continuous paper R at the positions IB and IC on the continuous paper R simultaneously in accordance with control by the controller 10. The two cutters 161 cut the continuous paper R at the positions ID and IE on the continuous paper R simultaneously in accordance with control by the controller 10. The two cutters 161 cut the continuous paper R at the positions IF and IG on the continuous paper R simultaneously in accordance with control by the controller 10. The two cutters 161 cut the continuous paper R at the positions IH and II on the continuous paper R simultaneously in accordance with control by the controller 10.

Since the two cutters 161 can cut the continuous paper R at two positions simultaneously in a single cutting operation of the two cutters 161 as described above, the ink jet printer 1 can generate a printed matter not having a white space in the transport direction HY more quickly than the foregoing embodiments.

A length of each of inter-image regions GMA in the transport direction HY is determined based on a distance between the two cutters 161 in the transport direction HY.

Fourth Embodiment

Inter-image regions GMA in which test patterns TP are formed are different for colors of ink.

When the ink jet head 151 includes the 6 nozzle arrays NzR as illustrated in FIGS. 2 and 5, the printing section 15 forms the test pattern TP in a single inter-image region GMA by the nozzles Nz of the nozzle array NzR-1 that are included in the nozzle group GP1 in accordance with control by the controller 10. After that, the printing section 15 sequentially forms the test pattern TP in the single inter-image region GMA by the nozzles Nz of the nozzle array NzR-1 that are included in the nozzle group GP2, forms the test pattern TP in the single inter-image region GMA by the nozzles Nz of the nozzle array NzR-1 that are included in the nozzle group GP3, and forms the test pattern TP in the single inter-image region GMA by the nozzles Nz of the nozzle array NzR-1 that are included in the nozzle group GP4. After the test patterns TP are formed by all the nozzles Nz of the nozzle array NzR-1, the printing section 15 forms test patterns TP by the other nozzle arrays NzR-2 and the like in the same manner as described above. In accordance with control by the controller 10, the printing section 15 forms the test pattern TP in a next inter-image region GMA by the nozzles Nz of the nozzle array NzR-2 that are included in the nozzle group GP1. After that, the printing section 15 forms the test patterns TP in different inter-image regions GMA by the nozzles Nz included in the nozzle arrays NzR-3 to NzR-6 and included in the nozzle group GP1. In this case, the nozzle group corresponds to a single nozzle array NzR.

According to the foregoing operations, the test pattern TP formed in an inter-image region GMA to be separated from the continuous paper R can be treated as a test pattern of nozzles Nz that eject ink of the same color. Therefore, whether each of the nozzles Nz is in the defective state and whether each of the nozzles Nz causes the flight deviation are easily checked for each of the colors.

According to the foregoing embodiments, the following effects are obtained.

A first image, a second image, and a third image that are used to explain the following effects do not indicate specific images formed on the continuous paper R. The first image indicates an image formed on the continuous paper R. The second image indicates an image formed after the formation of the first image and adjacent to the first image. The third image indicates an image formed after the formation of the second image and adjacent to the second image.

A first printed matter and a second printed matter that are used to explain the following effects do not indicate specific printed matters generated by the ink jet printer 1. The first printed matter indicates a printed matter with the first image printed thereon. The second printed matter indicates a printed matter with the second image printed thereon.

Ink of a first color and ink of a second color that are used to explain the following effects do not indicate ink of specific colors. The ink of the first color indicates ink of an arbitrary color. The ink of the second color indicates ink of a color different from the arbitrary color.

A nozzle for the first color and a nozzle for the second color that are used to explain the following effects do not indicate nozzles Nz that eject ink of specific colors. The nozzle for the first color indicates a nozzle Nz that ejects the ink of the arbitrary color. The nozzle for the second color indicates a nozzle Nz that ejects the ink of the color different from the arbitrary color.

The ink jet printer 1 includes the transporting section 14 that transports the continuous paper R in the transport direction HY, the ink jet head 151 forming the nozzle arrays NzR, each having a plurality of nozzles Nz aligned in the transport direction HY, the cutting section 16 that cuts the continuous paper R in the intersecting direction HY, and the controller 10 that controls the transporting section 14, the ink jet head 151, and the cutting section 16. The controller 10 causes the ink jet head 151 to form, on the continuous paper R, the first and second images that are adjacent to one another in the transport direction HY, causes a nozzle among the nozzles Nz aligned in the nozzle arrays NzR to form the test pattern TP, and causes the cutting section 16 to cut the continuous paper R to separate, from the continuous paper R, an inter-image region GMA with the test pattern TP formed therein.

An image formation method by the ink jet printer 1 includes transporting the continuous paper R in the transport direction HY and causing the ink jet head 151 forming the nozzle arrays NzR, each having a plurality of nozzles Nz aligned in the transport direction HY, to form the first image on the continuous paper R. The image formation method by the ink jet printer 1 includes causing a nozzle among the nozzles Nz forming the nozzle arrays NzR to form the test pattern TP that is upstream with respect to the first image in the transport direction HY after the formation of the first image. The image formation method by the ink jet printer 1 includes forming the second image that is upstream with respect to the test pattern TP in the transport direction HY after the formation of the test pattern TP and cutting the continuous paper R in the second direction intersecting the first direction to separate, from the continuous paper R, the inter-image region GMA that has the test pattern TP formed therein and is between the first printed matter with the first image printed thereon and the second printed matter with the second image printed thereon.

According to the ink jet printer 1 and the image formation method by the ink jet printer 1, the test pattern TP is formed, while the region that is between the first and second images and is to be separated from the continuous paper R by the cutting is effectively used. Therefore, according to the ink jet printer 1 and the image formation method by the ink jet printer 1, it is possible to reduce a region that is not used to form an image other than the test pattern TP.

The controller 10 causes the cutting section 16 to cut the continuous paper R to generate a printed matter including a portion of the first image and not having a white space in the transport direction HY and a printed matter including a portion of the second image and not having a white space in the transport direction HY.

According to this configuration, in the generation of the printed matters that do not have a white space in the transport direction HY, it is possible to reduce a region that is not used to form an image other than the test pattern TP.

In the image formation method by the ink jet printer 1, in the cutting of the continuous paper R in the intersecting direction KY, the first and second printed matters that do not have a white space in the transport direction HY are generated by cutting the portion of the first image and the portion of the second image.

According to this configuration, in the generation of the printed matters that do not have a white space in the transport direction HY, it is possible to reduce a region that is not used to form an image other than the test pattern TP.

A length of an inter-image region GMA with the test pattern TP formed therein in the transport direction HY is shorter than a length in the transport direction HY of each of the nozzle arrays NzR, each having a plurality of nozzles Nz aligned in the transport direction HY.

According to this configuration, while the length of the inter-image region GMA in the transport direction HY is set to be shorter than the entire length in the transport direction HY of each of the nozzle arrays NzR, each having a plurality of nozzles Nz aligned in the transport direction HY, it is possible to form a plurality of images other than the test pattern TP. Therefore, it is possible to reduce a region that is not used to form an image other than the test pattern TP.

The controller 10 causes a nozzle among the nozzles Nz of the ink jet head 151 to form the test pattern TP in a region between the second and third images formed by the ink jet head 151 and adjacent to one another in the transport direction HY on the continuous paper R. In this case, the nozzle Nz that forms the test pattern TP in the region between the second and third images is different from the nozzle Nz that has formed the test pattern TP in the region between the first and second images.

According to this configuration, it is possible to reduce a region that is not used to form an image, and it is possible to form test patterns TP using all the nozzles Nz included in the ink jet head 151.

The inter-image region GMA with the test pattern TP formed between the first and second images has the same length in the transport direction HY as a length of the second inter-image region GMA with the test pattern TP formed between the second and third images in the transport direction HY.

According to this configuration, in the formation of the test patterns TP, the controller 10 does not need to execute a process of forming the test patterns TP based on the lengths of the inter-image regions GMA in the transport direction HY. Therefore, it is possible to reduce a region that is not used to form an image other than the test patterns TP.

In the ink jet head 151, a nozzle array NzR of a plurality of first-color nozzles that eject ink of the first color and a nozzle array NzR of a plurality of second-color nozzles that eject ink of the second color are arranged side by side in the intersecting direction HY. The controller 10 causes the nozzle array NzR of the first-color nozzles Nz to form the test pattern TP in the region between the first and second images. The controller 10 causes the nozzle array NzR of the second-color nozzles Nz to form the test pattern TP in the region between the second and third images.

According to this configuration, the test pattern TP formed in an inter-image region GMA to be separated from the continuous paper R can be treated as a test pattern TP of nozzles Nz that eject ink of the same color. Therefore, to check whether each of the nozzles Nz is in the defective state and whether each of the nozzles Nz causes the flight deviation, it is not necessary that a user check a large number of portions including inter-image regions GMA separated from the continuous paper R. Therefore, the ink jet printer 1 can improve user's convenience for checking, for each of the colors, whether each of the nozzles Nz is in the defective state and whether each of the nozzles Nz causes the flight deviation.

The foregoing embodiments merely indicate aspects of the disclosure and can be arbitrarily modified and applied within the scope of the disclosure.

Although the foregoing embodiments exemplify the test pattern TP to be used to detect whether each of the nozzles Nz is in the defective state and whether each of the nozzles Nz causes the flight deviation, a test pattern TP to be used to detect another factor, such as color unevenness, may be formed in an inter-image region GMA.

Although the foregoing embodiments exemplify the serial ink jet printer as the ink jet printer 1, the ink jet printer 1 may be a line ink jet printer including a line-type print head.

The functions of the controller 10 may be enabled by a plurality of processors or a semiconductor chip.

The sections illustrated in FIG. 1 are an example, and the implementation form of the sections is not limited. Hardware that corresponds to the sections may not be implemented. The functions of the sections may be enabled by causing a single processor to execute a program. A function that is among the functions and enabled by software may be hardware. A function that is among the functions and enabled by hardware may be enabled by software. Detailed configurations of the other sections of the ink jet head 1 may be arbitrarily changed without departing from the gist of the disclosure.

The operation described with reference to FIG. 4 is divided into the steps illustrated in FIG. 4 based on the details of the main processes in order to easily understand the operation of the ink jet printer 1 and is not limited based on how the operation is divided into process units and on the names of the process units. The operation may be divided into a larger number of steps based on the details of the processes. In addition, the operation may be divided into steps such that each of the steps includes a larger number of processes. The order of the steps may be changed without departing from the gist of the disclosure.

What is claimed is:

1. An image forming device comprising:

a transport roller configured to transport continuous paper in a first direction;

an ink jet head including a nozzle array having a plurality of nozzles aligned in the first direction;

a cutter configured to cut the continuous paper in a second direction intersecting the first direction; and a controller configured to control the transport roller, the ink jet head, and the cutter, wherein the controller causes the ink jet head to form, on the continuous paper, a first image and a second image that are adjacent to one another in the first direction, causes a nozzle among the nozzles included in the nozzle array to form a test pattern in a region between the first image and the second image, and causes the cutter to cut the continuous paper to separate, from the continuous paper, the region in which the test pattern was formed, and the region has a shorter length in the first direction than a length of the nozzle array in the first direction.

2. The image forming device according to claim 1, wherein, the controller causes the cutter to cut a portion of the first image and a portion of the second image to generate a printed matter not having a white space in the first direction.

3. The image forming device according to claim 1, wherein, the controller causes the ink jet head to form, on the continuous paper, a third image that is adjacent to the second image in the first direction, and causes a nozzle that is different from the nozzle that formed the test pattern in the region, on the continuous paper, the test pattern in a second region between the second image and the third image.

4. The image forming device according to claim 3, wherein the region has the same length in the first direction as a length in the first direction of the second region.

5. The image forming device according to claim 3, wherein the ink jet head includes a second nozzle array arranged side by side with the nozzle array in the second direction and having a plurality of nozzles aligned therein, the nozzle array ejects ink of a first color, the second nozzle array ejects ink of a second color, and the nozzle that forms the test pattern in the second region between the second image and the third image is included in the second nozzle array.

6. An image formation method comprising:

transporting continuous paper in a first direction;

forming a first image on the continuous paper by an ink jet head including a nozzle array having a plurality of nozzles aligned in the first direction;

forming a test pattern by a nozzle among the nozzles included in the nozzle array, the test pattern being upstream with respect to the first image in the first direction;

forming a second image by the ink jet head, the second image being upstream with respect to the test pattern in the first direction; and separating a region in which the test pattern was formed and that is between the first image and the second image from a first printed matter with the first image printed thereon and a second printed matter with the second image printed thereon by cutting the continuous paper in a second direction intersecting the first direction, wherein the region in which the test pattern was formed has a shorter length in the first direction than a length of the nozzle array in the first direction.

7. The image formation method according to claim 6, further comprising:

generating the first and second printed matters not having a white space in the first direction in the cutting a portion of the first image and a portion of the second image of the continuous paper.

8. The image formation method according to claim 6, further comprising:

forming by the ink jet head a third image that is adjacent to the second image in the first direction on the continuous paper; and forming the test pattern in a second region between the second image and the third image by a nozzle that is different from the nozzle that formed the test pattern in the region on the continuous paper.

9. The image formation method according to claim 8, wherein the region in which the test pattern was formed has the same length in the first direction as a length in the first direction of the second region in which the test pattern was formed.

10. The image formation method according to claim 8, wherein the ink jet head includes a second nozzle array arranged side by side with the nozzle array in the second direction and having a plurality of nozzles aligned therein, the nozzle array ejects ink of a first color, the second nozzle array ejects ink of a second color, and the nozzle that forms the test pattern in the second region is included in the second nozzle array.

* * * * *